US011047621B2

(12) United States Patent
Rideout et al.

(10) Patent No.: US 11,047,621 B2
(45) Date of Patent: Jun. 29, 2021

(54) HEATED OUTDOOR STORAGE ASSEMBLY

(71) Applicants: Harvey Rideout, Sydenham (CA); Wendy Rideout, Sydenham (CA)

(72) Inventors: Harvey Rideout, Sydenham (CA); Wendy Rideout, Sydenham (CA)

( * ) Notice: Subject to any disclaimer, the term of this patent is extended or adjusted under 35 U.S.C. 154(b) by 45 days.

(21) Appl. No.: 16/660,476

(22) Filed: Oct. 22, 2019

(65) Prior Publication Data

US 2021/0116176 A1 Apr. 22, 2021

(51) Int. Cl.

| | |
|---|---|
| ***F26B 9/06*** | (2006.01) |
| ***D06F 58/10*** | (2006.01) |
| ***A47K 10/06*** | (2006.01) |
| ***F26B 25/12*** | (2006.01) |
| ***F26B 25/10*** | (2006.01) |

(52) U.S. Cl.

CPC ..... *F26B 9/06* (2013.01); *A47K 10/06* (2013.01); *D06F 58/10* (2013.01); *F26B 25/10* (2013.01); *F26B 25/12* (2013.01)

(58) Field of Classification Search

CPC . F26B 9/06; F26B 25/00; F26B 25/12; A47K 10/06

USPC ..... 34/202

See application file for complete search history.

(56) References Cited

U.S. PATENT DOCUMENTS 30,105 A * 9/1860 Colby ..... F26B 9/06 34/197
102,230 A * 4/1870 Cox ..... F26B 9/06 34/233
204,452 A * 6/1878 Rinehart ..... F26B 9/06 34/233
219,093 A * 9/1879 Henderson ..... F26B 9/06 34/233
1,762,910 A * 6/1930 Thomas ..... G03D 15/027 34/77
2,464,706 A * 3/1949 McGraw ..... A62C 33/02 34/80
2,484,527 A * 10/1949 Rhoads ..... F26B 21/08 34/537
3,362,081 A * 1/1968 Bogenberger ..... D06F 58/10 34/467
3,590,594 A * 7/1971 Arend ..... F25D 17/065 62/117
3,839,622 A * 10/1974 Mastin ..... A47K 10/06 219/400

(Continued)

FOREIGN PATENT DOCUMENTS

EP 3567155 A1 * 11/2019 ..... D06F 58/20

*Primary Examiner* — Stephen M Gravini

(57) ABSTRACT

A heated outdoor storage assembly for warming and drying towels includes a housing that defines an interior space. An aperture that is positioned in a front of the housing is configured to allow access to the interior space. A door that is hingedly coupled to the housing is positioned to be selectively hinged to the housing to close the aperture. A set of shelves, which is selectively couplable to the housing so that each shelf extends between opposing sides of the housing, is configured to stow an article. Each of a set of slots is positioned in a respective shelf so that the set of slots is configured to allow flow of air through the set of shelves. A heating module coupled to the housing and positioned in the interior space proximate to a bottom of the housing is configured to heat the air to warm and dry the article.

18 Claims, 5 Drawing Sheets

(56) References Cited

U.S. PATENT DOCUMENTS 4,110,916 A * 9/1978 Bemrose ..... A23B 7/0205 34/197
4,813,475 A * 3/1989 Couvrette ..... G05D 23/1919 109/2
5,555,640 A * 9/1996 Ou ..... A47L 19/00 211/133.6
5,755,040 A * 5/1998 Ou ..... A47L 23/205 34/202
6,018,885 A 2/2000 Hill
6,175,970 B1 1/2001 Pinciaro
6,693,260 B1 2/2004 Rodrigues
6,845,569 B1 * 1/2005 Kim ..... A47L 23/20 34/106
6,889,449 B2 * 5/2005 Silver ..... F26B 9/06 34/389
7,137,211 B2 * 11/2006 Johnson ..... D06F 58/10 34/381
7,171,761 B1 * 2/2007 Hunts ..... D06F 58/10 219/400
7,377,052 B2 * 5/2008 Maruca ..... D06F 58/10 236/44 C
8,056,252 B2 * 11/2011 Fernandes ..... F26B 21/00 34/60
8,166,667 B1 * 5/2012 Lora ..... D06F 58/10 34/202
D663,495 S 7/2012 Song
8,516,714 B2 * 8/2013 Biemans ..... A61K 9/19 34/284
8,695,228 B2 * 4/2014 Lee ..... D06F 58/20 34/86
9,709,327 B2 * 7/2017 Marchiori ..... F26B 5/12
10,400,384 B2 * 9/2019 Park ..... D06F 58/20
2004/0134087 A1 * 7/2004 Meyer ..... D06F 58/10 34/90
2005/0166419 A1 * 8/2005 Regelski ..... D06F 58/10 34/202
2006/0137210 A1 * 6/2006 Lee ..... D06F 58/20 34/201
2007/0068035 A1 * 3/2007 Theriault ..... F26B 9/066 34/523
2008/0168675 A1 * 7/2008 Garman ..... F26B 9/003 34/195
2010/0071227 A1 * 3/2010 Khoshnood ..... F26B 25/063 34/443
2012/0055039 A1 * 3/2012 Watson ..... D06F 58/10 34/218
2014/0109433 A1 * 4/2014 Moore ..... D06F 57/08 34/282
2015/0113827 A1 * 4/2015 Goulet ..... F26B 20/00 34/443
2016/0223257 A1 * 8/2016 Romanek ..... F26B 3/28
2016/0374447 A1 * 12/2016 Sterling ..... A61L 2/10 34/275

* cited by examiner

HEATED OUTDOOR STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage assemblies and more particularly pertains to a new storage assembly for warming and drying towels.

(2) Description of Related Art Including Information Disclosed Under 37 CFR 1.97 and 1.98

The prior art relates to storage assemblies.

BRIEF SUMMARY OF THE INVENTION

An embodiment of the disclosure meets the needs presented above by generally comprising a housing that defines an interior space. An aperture that is positioned in a front of the housing is configured to allow access to the interior space. A door that is hingedly coupled to the housing is positioned to be selectively hinged relative to the housing to close the aperture. A set of shelves, which is selectively couplable to the housing so that each shelf extends between opposing sides of the housing, is configured to stow an article. Each of a set of slots is positioned in a respective shelf so that the set of slots is configured to allow flow of air through the set of shelves. A heating module that is coupled to the housing and positioned in the interior space proximate to a bottom of the housing is configured to heat the air to warm and dry the article.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
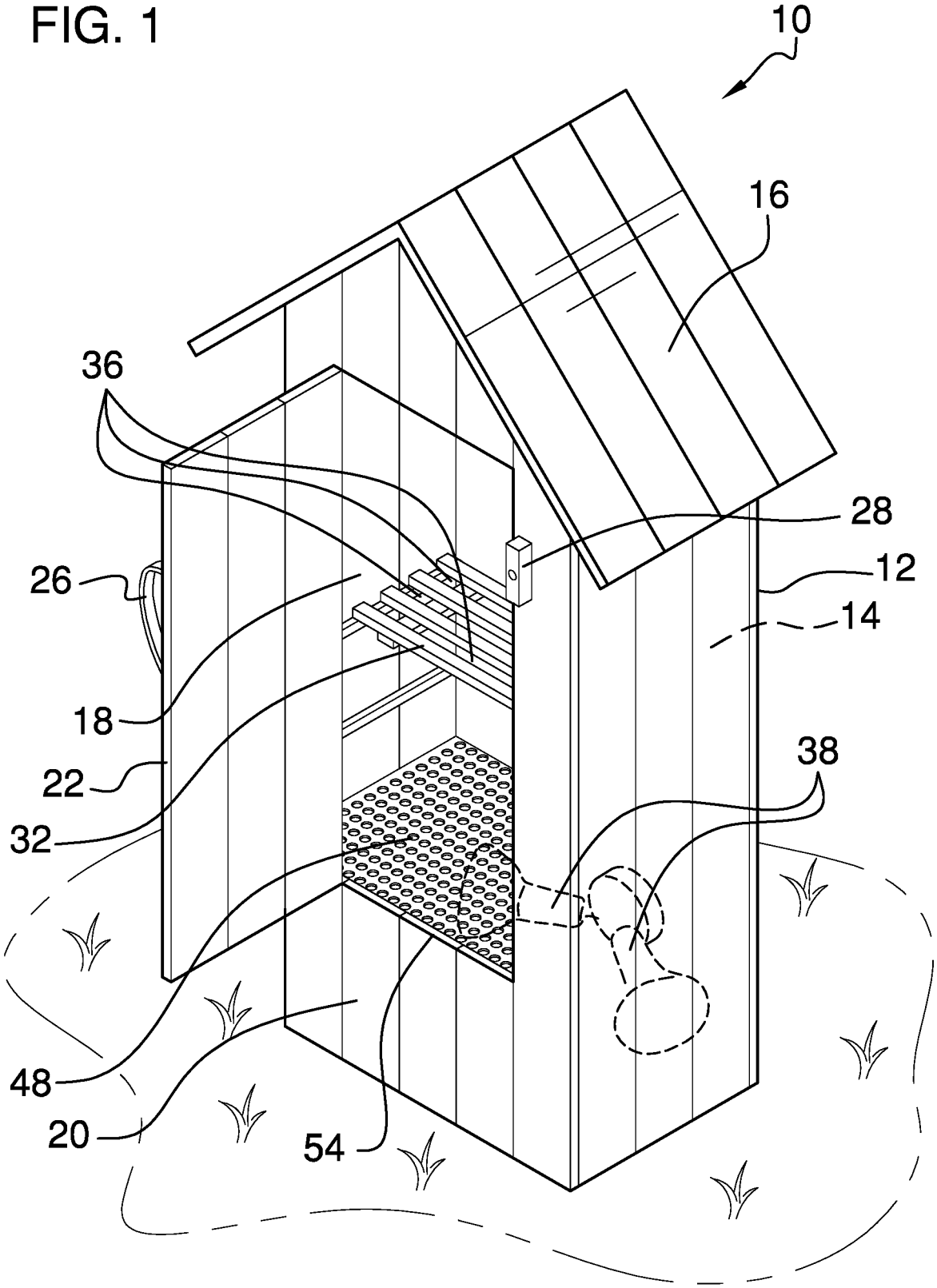
FIG. 1 is an isometric perspective view of a heated outdoor storage assembly according to an embodiment of the disclosure.
Figure 2:
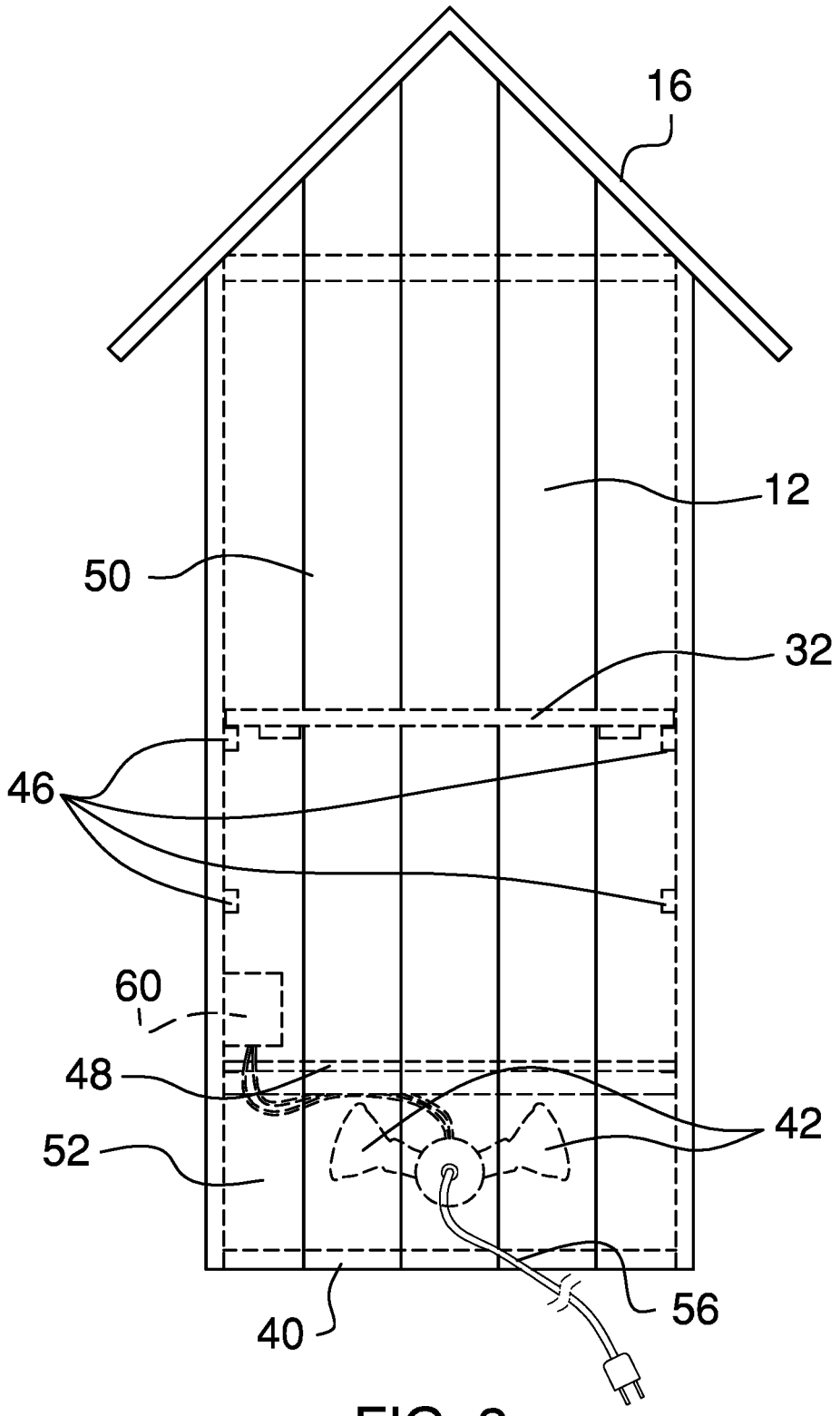
FIG. 2 is a back view of an embodiment of the disclosure.

With reference now to the drawings, and in particular to FIGS. 1 through 5 thereof, a new storage assembly embodying the principles and concepts of an embodiment of the disclosure and generally designated by the reference numeral 10 will be described.

As best illustrated in FIGS. 1 through 5, the heated outdoor storage assembly 10 generally comprises a housing 12 that defines an interior space 14. The housing 12 comprises a roof 16 that may be gable type so that the roof 16 is configured to shed water. Other configurations of the roof 16 are anticipated, such as hip, gambrel, mansard, and the like.

An aperture 18 that is positioned in a front 20 of the housing 12 is configured to allow access to the interior space 14. A door 22 is hingedly coupled to the housing 12 proximate to the aperture 18. The door 22 is complementary to the aperture 18 so that the door 22 is positioned to be selectively hinged relative to the housing 12 to close the aperture 18.

Figure 4:
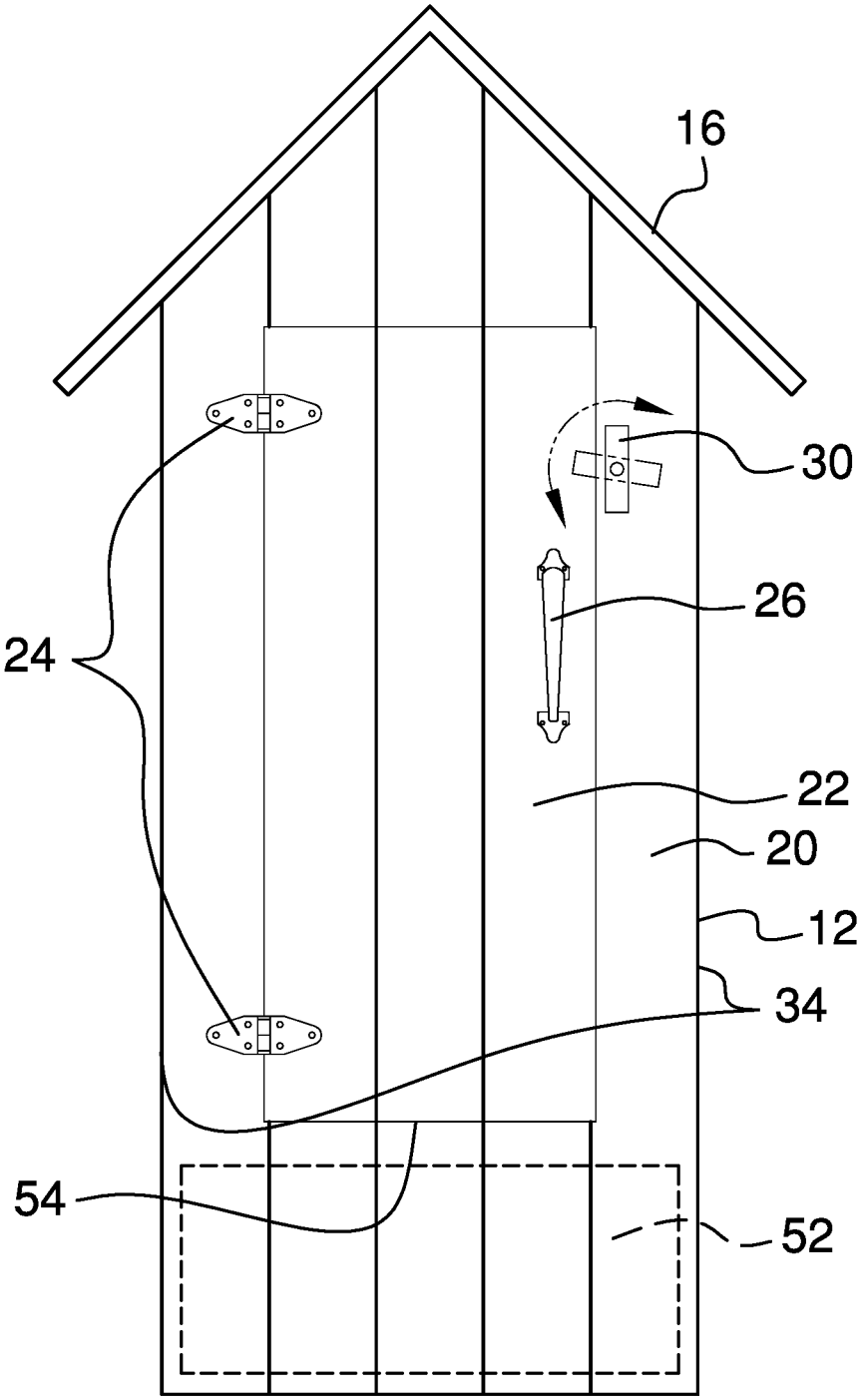
FIG. 4 is a front view of an embodiment of the disclosure.

A set of hinges 24 is coupled to and extends between the door 22 and the housing 12 so that the door 22 is hingedly coupled to the housing 12. The set of hinges 24 comprises from one to three hinges 24. For example, the set of hinges 24 may comprise one hinge 24 that is piano type, two hinges 24 that are barrel type, as shown in FIG. 4, or three hinges 24 that are barrel type. A handle 26 that is coupled to the door 22 is configured to be grasped in a hand of a user to hinge the door 22 relative to the housing 12.

A locking means 28 that is coupled to the housing 12 is selectively couplable to the door 22 to fixedly position the door 22 in the opening. The locking means 28 may comprise a peg 30 that is rotationally coupled to the housing 12. The peg 30 is configured to be selectively rotated from a vertical configuration to a horizontal configuration to fixedly position the door 22 in the opening. The locking means 28 also may comprises other types of closures, such as, but not limited to, magnetic closures, latches, and the like.

Figure 5:
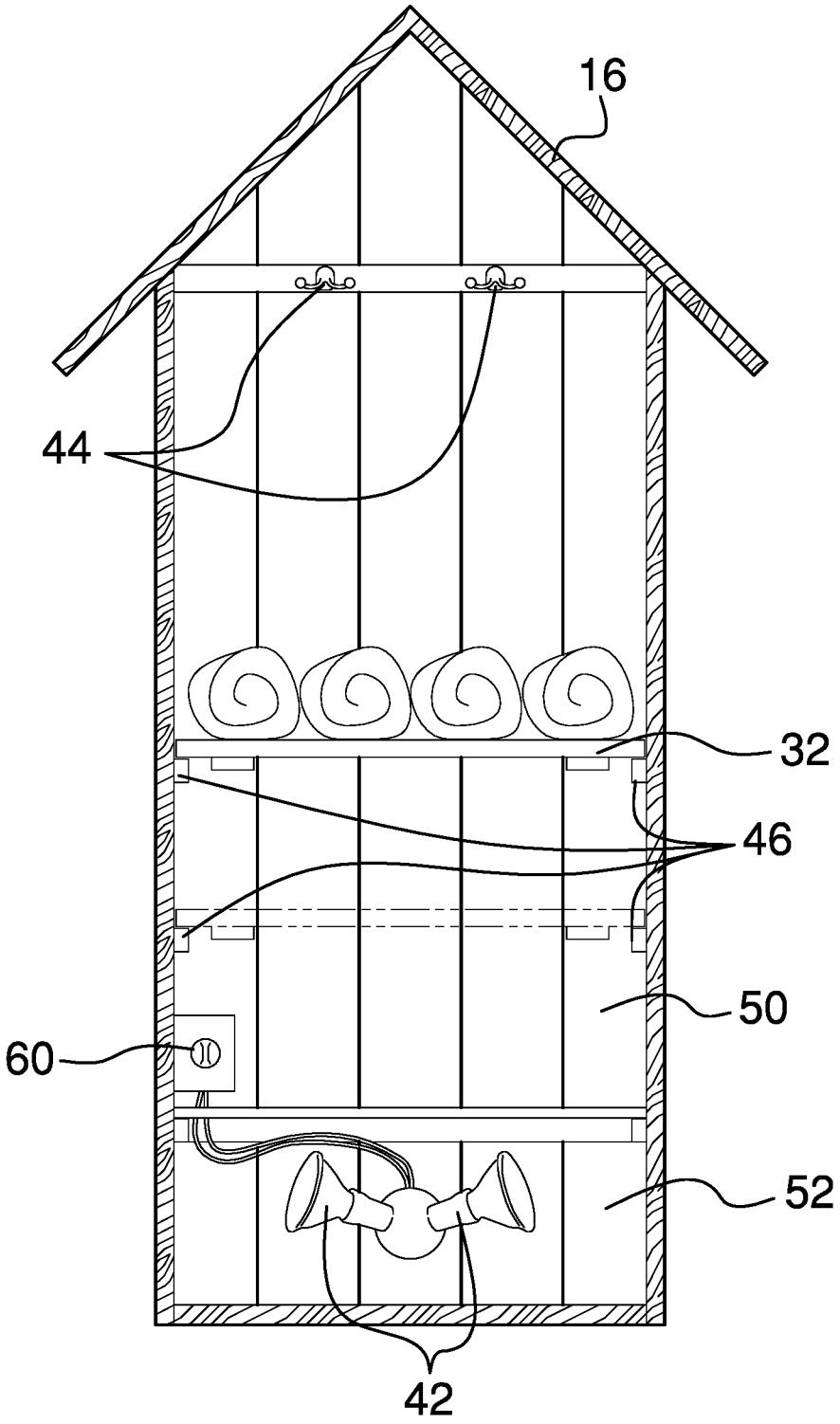
FIG. 5 is a cross-sectional view of an embodiment of the disclosure.

A set of shelves 32 is selectively couplable to the housing 12 so that each shelf 32 extends between opposing sides 34 of the housing 12. The shelf 32 is configured to stow an article, such as a towel as shown in FIG. 5. The set of shelves 32 comprises from one to four shelves 32. For example, the set of shelves 32 may comprise one shelf 32, as shown in FIG. 1. Each of a set of slots 36 is positioned in a respective shelf 32 so that the set of slots 36 is configured for air to flow through the set of shelves 32.

A heating module 38 is coupled to the housing 12 and is positioned in the interior space 14 proximate to a bottom 40 of the housing 12. The heating module 38 is configured to heat the air to warm and to dry the article, such as towels as shown in FIG. 5. The assembly 10 is anticipated to be useful in proximity to an outdoor hot tub in cold environments.

The heating module 38 may comprise a set of heat lamps 42, or other heating means, such as, but not limited to, radiant heaters, convective heaters, and the like. The set of heat lamps 42 comprises from one to three heat lamps 42. For example, the set of heat lamps 42 may comprise two heat lamps 42, as shown in FIG. 5.

A set of hooks 44 is coupled to the housing 12 and is positioned in the interior space 14. Each hook 44 is configured to hang an item, such as a robe. The heating module 38 is configured to heat the air to warm and to dry the item. The set of hooks 44 comprises from one to three hooks 44. For example, the set of hooks 44 may comprise two hooks 44, as shown in FIG. 5.

Each of a set of slats 46 is coupled to a respective opposing side 34 of the housing 12 and is positioned in the interior space 14 so that respective slats 46 are positioned to support a respective shelf 32 parallel to the bottom 40 of the housing 12. The set of slats 46 may comprise four slats 46 that are positioned two-apiece on each opposing side 34, as shown in FIG. 5, providing a user options to position two shelves 32 in the interior space 14 or one shelf 32 in one of two positions within the interior space 14.

A grate 48 is coupled to the housing 12 that defines an upper chamber 50 and a lower chamber 52 within the interior space 14. The grate 48 is positioned proximate to a lower edge 54 of the aperture 18 and is parallel to the bottom 40. The heating module 38 is positioned in the lower chamber 52. The set of shelves 32 is positioned in the upper chamber 50 so that the grate 48 is configured to prevent the article from coming into contact with the heating module 38. The grate 48 may comprise peg board, or other grated panel, such as, but not limited to, screens, meshes, and the like.

A power module 56 is coupled to the housing 12 and is positioned in the interior space 14. The power module 56 is operationally coupled to the heating module 38 so that the power module 56 is positioned to selectively power the heating module 38. The power module 56 may comprise a power cord 58 that is coupled to the heating module 38 and which extends from the housing 12. The power cord 58 is configured to operationally couple the heating module 38 to a source of alternating current. The power module 56 also may comprise other powering means, such as, but not limited to, batteries, generators, and the like.

A controller 60 that is coupled to the housing 12 is operationally coupled to the power module 56 and the heating module 38. The controller 60 is timer type so that the controller 60 is positioned to selectively actuate the heating module 38 for a selected period of time. The controller 60 is positioned within the upper chamber 50 so that the housing 12 is configured to shield the controller 60 from precipitation.

Figure 3:
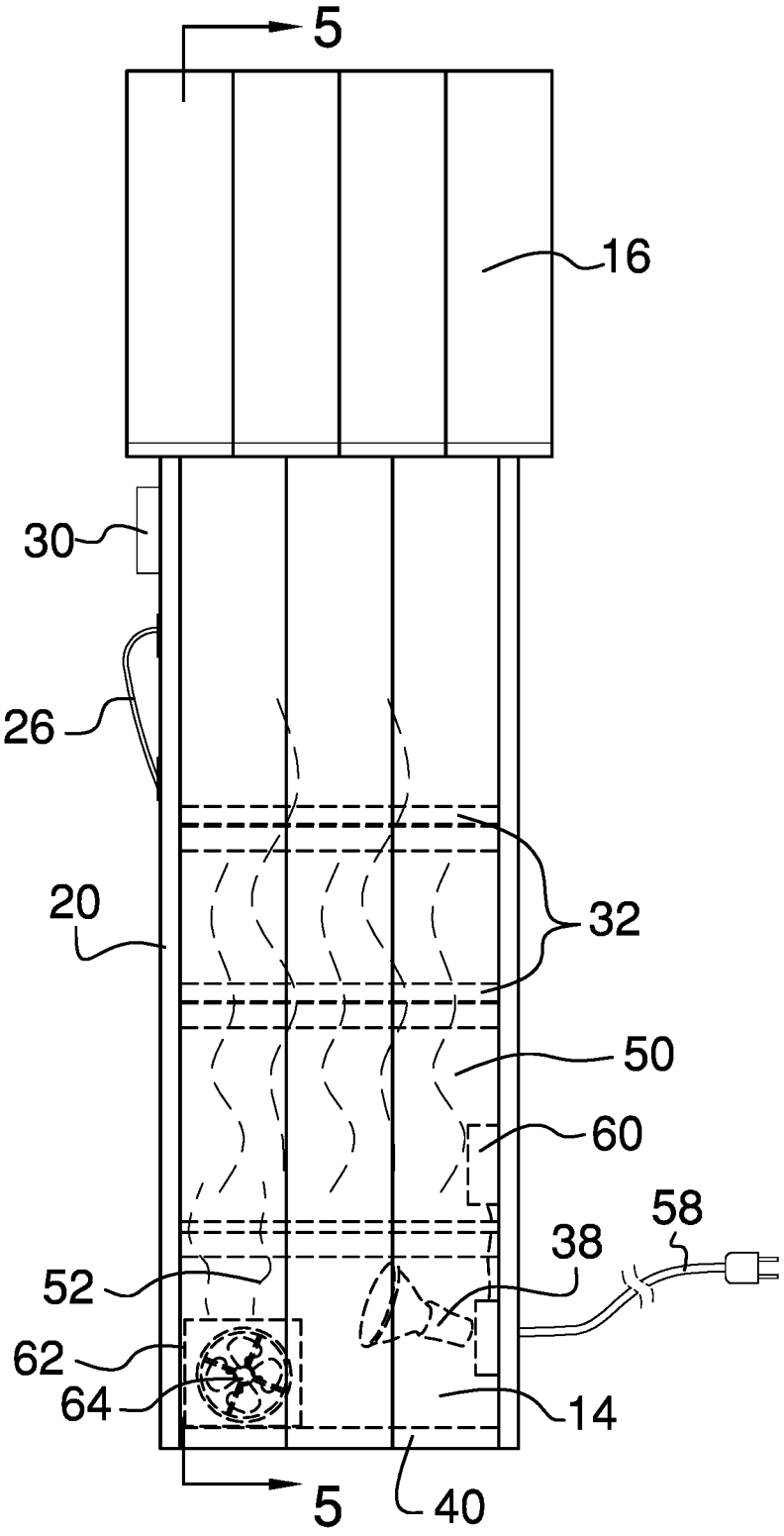
FIG. 3 is a side view of an embodiment of the disclosure.

A blower module 62 may be coupled to the housing 12 and positioned in the interior space 14 proximate to the heating module 38, as shown in FIG. 3. The blower module 62 is operationally coupled to the power module 56 and the controller 60. The blower module 62 is configured to circulate heated air within the interior space 14 to enhance the warming and the drying of the article. The blower module 62 comprises a fan 64.

In use, the housing 12 is positioned proximate to a hot tub. The controller 60 is used to actuate the set of heat lamps 42 to warm and dry the towels and the robes that are positioned on the shelves 32 and hooks 44, respectively. Upon exiting the hot tub, the user has a towel and a robe available for use that are both warm and dry. After use, the towel and robe can be placed back into the interior space 14 to be dried.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A heated outdoor storage assembly comprising:

a housing defining an interior space;

an aperture positioned in a front of the housing wherein the aperture is configured for accessing the interior space;

a door hingedly coupled to the housing proximate to the aperture, the door being complementary to the aperture such that the door is positioned for selectively hinging relative to the housing for closing the aperture;

a set of shelves selectively couplable to the housing such that each shelf extends between opposing sides of the housing wherein the shelf is configured for stowing an article;

a set of slots, each slot being positioned in a respective shelf wherein the set of slots is configured for flowing of air through the set of shelves;

a heating module coupled to the housing and positioned in the interior space proximate to a bottom of the housing wherein the heating module is configured for heating the air for warming and drying the article; and a locking means coupled to the housing, the locking means being selectively couplable to the door for fixedly positioning the door in the opening.

2. The assembly of claim 1, further including the housing comprising a roof, the roof being gable type such that the roof is configured for shedding water.

3. The assembly of claim 1, further including a set of hinges coupled to and extending between the door and the housing such that the door is hingedly coupled to the housing, the set of hinges comprising from one to three hinges.

4. The assembly of claim 1, further including a handle coupled to the door wherein the handle is configured for grasping in a hand of a user for hinging the door relative to the housing.

5. The assembly of claim 1, further including the locking means comprising a peg rotationally coupled to the housing wherein the peg is configured for selectively rotating from a vertical configuration to a horizontal configuration for fixedly positioning the door in the opening.

6. The assembly of claim 1, further including the set of shelves comprising from one to four shelves.

7. The assembly of claim 1, further including the heating module comprising a set of heat lamps, the set of heat lamps comprising from one to three heat lamps.

8. The assembly of claim 1, further including a set of hooks coupled to the housing and positioned in the interior space wherein each hook is configured for hanging an item wherein the heating module is configured for heating the air for warming and drying the item, the set of hooks comprising from one to three hooks.

9. The assembly of claim 1, further including a set slats, each slat being coupled to a respective opposing side of the housing and positioned in the interior space such that respective slats are positioned for supporting a respective shelf parallel to the bottom of the housing.

10. The assembly of claim 1, further including a grate coupled to the housing defining an upper chamber and a lower chamber within the interior space, the grate being positioned proximate to a lower edge of the aperture, the grate being parallel to the bottom, the heating module being positioned in the lower chamber, the set of shelves being positioned in the upper chamber wherein the grate is configured for preventing the article from contacting the heating module.

11. The assembly of claim 10, further including the grate comprising peg board.

12. The assembly of claim 1, further including a power module coupled to the housing and positioned in the interior space, the power module being operationally coupled to the heating module such that the power module is positioned for selectively powering the heating module.

13. The assembly of claim 12, further including the power module comprising a power cord coupled to the heating module and extending from the housing wherein the power cord is configured for operationally coupling the heating module to a source of alternating current.

14. The assembly of claim 12, further including a controller coupled to the housing, the controller being operationally coupled to the power module and the heating module, the controller being timer type such that the controller is positioned for selectively actuating the heating module for a selected period of time.

15. The assembly of claim 14, further including the controller being positioned within the upper chamber wherein the housing is configured for shielding the controller from precipitation.

16. The assembly of claim 14, further including a blower module coupled to the housing and positioned in the interior space proximate to the heating module, the blower module being operationally coupled to the power module and the controller wherein the blower module is configured for circulating heated air within the interior space for enhancing the warming and the drying of the article.

17. The assembly of claim 16, further including the blower module comprising a fan.

18. A heated outdoor storage assembly comprising:

a housing defining an interior space, the housing comprising a roof, the roof being gable type such that the roof is configured for shedding water;

an aperture positioned in a front of the housing wherein the aperture is configured for accessing the interior space;

a door hingedly coupled to the housing proximate to the aperture, the door being complementary to the aperture such that the door is positioned for selectively hinging relative to the housing for closing the aperture;

a set of hinges coupled to and extending between the door and the housing such that the door is hingedly coupled to the housing, the set of hinges comprising from one to three hinges;

a handle coupled to the door wherein the handle is configured for grasping in a hand of a user for hinging the door relative to the housing;

a locking means coupled to the housing, the locking means being selectively couplable to the door for fixedly positioning the door in the opening, the locking means comprising a peg rotationally coupled to the housing wherein the peg is configured for selectively rotating from a vertical configuration to a horizontal configuration for fixedly positioning the door in the opening;

a set of shelves selectively couplable to the housing such that each shelf extends between opposing sides of the housing wherein the shelf is configured for stowing an article, the set of shelves comprising from one to four shelves;

a set of slots, each slot being positioned in a respective shelf wherein the set of slots is configured for flowing of air through the set of shelves;

a heating module coupled to the housing and positioned in the interior space proximate to a bottom of the housing wherein the heating module is configured for heating the air for warming and drying the article, the heating module comprising a set of heat lamps, the set of heat lamps comprising from one to three heat lamps;

a set of hooks coupled to the housing and positioned in the interior space wherein each hook is configured for hanging an item wherein the heating module is configured for heating the air for warming and drying the item, the set of hooks comprising from one to three hooks;

a set slats, each slat being coupled to a respective opposing side of the housing and positioned in the interior space such that respective slats are positioned for supporting a respective shelf parallel to the bottom of the housing;

a grate coupled to the housing defining an upper chamber and a lower chamber within the interior space, the grate being positioned proximate to a lower edge of the aperture, the grate being parallel to the bottom, the heating module being positioned in the lower chamber, the set of shelves being positioned in the upper chamber wherein the grate is configured for preventing the article from contacting the heating module, the grate comprising peg board;

a power module coupled to the housing and positioned in the interior space, the power module being operationally coupled to the heating module such that the power module is positioned for selectively powering the heating module, the power module comprising a power cord coupled to the heating module and extending from the housing wherein the power cord is configured for operationally coupling the heating module to a source of alternating current;

a controller coupled to the housing, the controller being operationally coupled to the power module and the heating module, the controller being timer type such that the controller is positioned for selectively actuating the heating module for a selected period of time, the controller being positioned within the upper chamber wherein the housing is configured for shielding the controller from precipitation; and a blower module coupled to the housing and positioned in the interior space proximate to the heating module, the blower module being operationally coupled to the power module and the controller wherein the blower module is configured for circulating heated air within the interior space for enhancing the warming and the drying of the article, the blower module comprising a fan.

* * * * *